US006773195B2

(12) United States Patent
Tims

(10) Patent No.: US 6,773,195 B2
(45) Date of Patent: Aug. 10, 2004

(54) NOTEBOOK WITH PORTFOLIO COVER

(75) Inventor: J. Michael Tims, Kettering, OH (US)

(73) Assignee: MeadWestvaco Corporation, Stamford, CT (US)

( * ) Notice: Subject to any disclaimer, the term of this patent is extended or adjusted under 35 U.S.C. 154(b) by 0 days.

(21) Appl. No.: 10/139,985

(22) Filed: May 7, 2002

(65) Prior Publication Data

US 2003/0210949 A1 Nov. 13, 2003

(51) Int. Cl.[7] ..... B42F 13/00

(52) U.S. Cl. ..... 402/73; 281/29; 281/31; 402/57; 402/500; 402/502

(58) Field of Search ..... 402/73, 57, 500, 402/502; 281/29, 31, 36, 37, 38

(56) References Cited

U.S. PATENT DOCUMENTS

| | | | | | |
|---|---|---|---|---|---|
| 67,163 | A | | 7/1867 | Buzby | |
| 102,189 | A | | 4/1870 | Williams | |
| 212,762 | A | | 2/1879 | Stromberg | |
| 231,394 | A | | 8/1880 | Brown | |
| 303,346 | A | | 8/1884 | Vernon | |
| 434,040 | A | | 8/1890 | Andrews | |
| 499,906 | A | | 6/1893 | Carnahan | |
| 665,256 | A | | 1/1901 | McComb | |
| 815,502 | A | | 3/1906 | Anderson | |
| 848,714 | A | | 4/1907 | Wise | |
| 938,910 | A | | 11/1909 | Sultzer | |
| 1,114,596 | A | | 10/1914 | Dustan | |
| 1,405,134 | A | | 1/1922 | Hoyme | |
| 1,460,426 | A | | 7/1923 | McSheehy | |
| 1,495,953 | A | | 5/1924 | Dick | |
| 1,526,044 | A | | 2/1925 | Blake | |
| 1,698,828 | A | | 1/1929 | Smith | |
| 1,717,801 | A | | 6/1929 | Metcalf | |
| 1,733,388 | A | | 10/1929 | Piltzer | |
| 1,861,459 | A | | 6/1932 | Smith | |
| 1,912,710 | A | | 6/1933 | Kennedy | |
| 2,136,186 | A | | 11/1938 | Frost | |
| 2,225,264 | A | | 12/1940 | Farrior, Jr. | |
| 2,596,131 | A | | 5/1952 | Darby et al. | |
| 2,828,975 | A | | 4/1958 | Wright | |
| 2,831,279 | A | * | 4/1958 | Esslinger, Jr. | 40/119 |
| 3,078,107 | A | | 2/1963 | Loderhose | |
| 3,188,113 | A | | 6/1965 | Cross | |
| 3,227,471 | A | | 1/1966 | Coniker | |
| 3,537,728 | A | | 11/1970 | Reese | |
| 3,565,462 | A | | 2/1971 | Gottlieb | |
| 3,837,680 | A | | 9/1974 | Cimini | |
| 3,870,223 | A | | 3/1975 | Wyant | |
| 4,420,112 | A | | 12/1983 | Cline | |
| 4,519,629 | A | | 5/1985 | Podosek | |
| 4,575,273 | A | * | 3/1986 | Gerriet | 402/75 |
| 4,620,725 | A | | 11/1986 | Maehashi | |
| 4,682,310 | A | | 7/1987 | Lund et al. | |
| 4,703,952 | A | | 11/1987 | Biasini | |
| 4,947,564 | A | * | 8/1990 | Reece et al. | 401/110 |
| D312,277 | S | | 11/1990 | Moor | |
| D320,411 | S | * | 10/1991 | Wyant | D19/27 |
| 5,174,674 | A | * | 12/1992 | Norwood | 402/73 |
| 5,215,398 | A | * | 6/1993 | White et al. | 402/73 |
| 5,284,242 | A | | 2/1994 | Roth et al. | |
| 5,330,281 | A | | 7/1994 | Kalan | |
| 5,445,417 | A | | 8/1995 | Bromer et al. | |
| 5,674,021 | A | | 10/1997 | Hutnick | |
| 5,676,482 | A | | 10/1997 | Hawkins | |
| 5,725,252 | A | | 3/1998 | Crum et al. | |
| 5,836,711 | A | | 11/1998 | Stewart | |
| 5,909,979 | A | | 6/1999 | Winzen | |
| 5,988,685 | A | | 11/1999 | Megelonsky et al. | |
| 5,997,207 | A | | 12/1999 | Robinson | |
| 6,024,508 | A | * | 2/2000 | Lippeth et al. | 402/73 |
| 6,079,614 | A | | 6/2000 | Ho | |
| 6,210,065 | B1 | | 4/2001 | Tower | |
| 6,213,670 | B1 | | 4/2001 | Wien | |
| 6,241,414 | B1 | | 6/2001 | Wien | |
| 6,267,413 | B1 | | 7/2001 | Tran | |
| 6,276,722 | B1 | | 8/2001 | Moor | |
| 6,371,679 | B1 | * | 4/2002 | Peleman | 402/73 |
| 6,379,070 | B1 | * | 4/2002 | Butchma | 402/73 |

* cited by examiner

*Primary Examiner*—Monica S. Carter
(74) *Attorney, Agent, or Firm*—Thompson Hine LLP

(57) ABSTRACT

A notebook including a plurality of sheets of paper, a binding mechanism binding the plurality of sheets together; and a cover bound to the plurality of sheets of paper by the binding mechanism. The cover includes first and second opposed panels coupled together and having a hinge line extending between the opposed panels. The cover includes a lower panel fixedly coupled to and facially abutting at least one of the panels to form a pocket therebetween.

41 Claims, 6 Drawing Sheets

NOTEBOOK WITH PORTFOLIO COVER

The present invention is directed to a notebook, and more particularly, to a notebook with a portfolio cover.

BACKGROUND OF THE INVENTION

Notebooks are widely used by students, professionals and other users as a device for supplying and carrying papers. Such notebooks may operate as a source for storing bound papers which may be able to be removed from the binding mechanism. However, notebooks are also often used alongside or in conjunction with various loose leaf papers, such as papers torn from the notebook, notes, handouts, or other loose items. Accordingly, there is a need for a notebook which can store loose items.

SUMMARY OF THE INVENTION

The present invention is a notebook with a portfolio cover which can store various loose items. In one embodiment, the portfolio includes a variety of pockets and/or a binding mechanism for storing loose papers.

In one embodiment, the invention is a notebook including a plurality of sheets of paper, a binding mechanism binding the plurality of sheets together, and a cover bound to the plurality of sheets of paper by the binding mechanism. The cover includes first and second opposed panels coupled together and having a hinge line extending between the opposed panels. The cover includes a lower panel fixedly coupled to and facially abutting at least one of the panels to form a pocket therebetween. Other objects and advantages will be apparent from the following description and the appended claims.

DETAILED DESCRIPTION

As best shown in FIGS. 1–4, in one embodiment the invention includes a notebook, generally designated 10, which includes a binding mechanism 12 which binds a plurality of sheets of paper 14 together. The binding mechanism 12 may be a coil or spiral binding mechanism or a double wire binding mechanism (together a "wire binding mechanism") which enables the sheets 14 captured therein to travel entirely or nearly entirely around the binding mechanism 12. For example, in one embodiment, each of the sheets 14 can travel at least 270°, and up to 360°, around the binding mechanism 12. However, the binding mechanism 12 is not limited to wire binding mechanisms, but can also be nearly any mechanism for binding a plurality of sheets together, such as an adhesive binding system, prong sets, clips, three-ring binders and other similar or well-known mechanisms.

Figure 4:
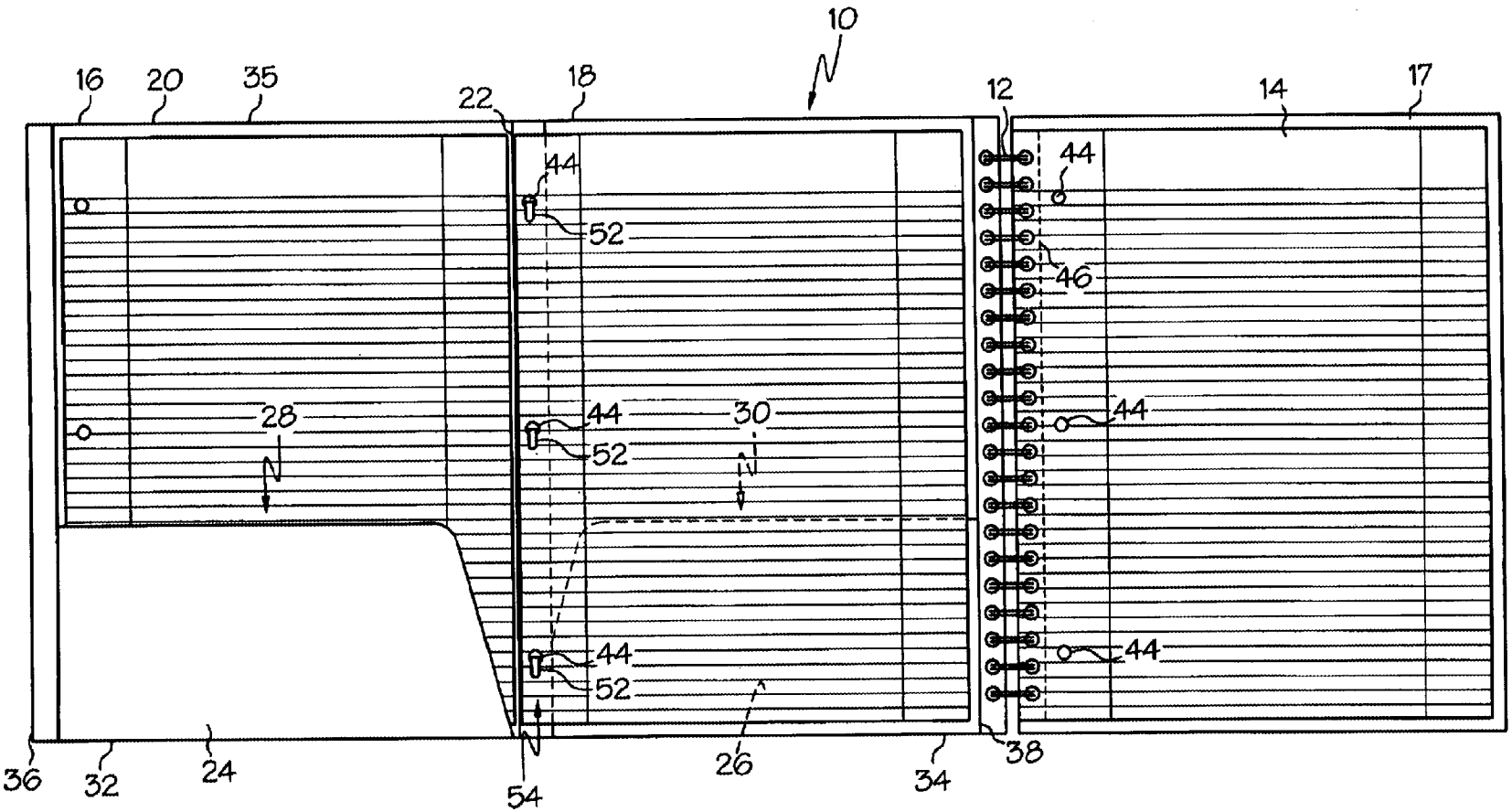
FIG. 4 is a top view of the notebook of FIG. 3, with the cover in its fully open or unfolded position and receiving a pair of papers therein.

The notebook 10 may include a cover 16 and a rear cover 17 bound to the binding mechanism 12. The rear cover 17 may be a generally flat, rigid rectangular piece of material (such as cardboard) and cover 16 is preferably in the form of a portfolio. In this case, the cover 16 may include a pair of opposed panels 18, 20 coupled together along a common hinge line 22 extending between the panels 18, 20. As shown in FIG. 4, one or both of the panels 18, 20 may have a lower panel 24, 26 or other piece of sheet-like material fixedly coupled thereto, such that a pocket 28, 30 is formed between each lower panel 24, 26 and its associated panel 18, 20. In one embodiment, each lower panel 24, 26 has about the same width and about one-third of the height of the associated panel 18, 20, and is fixedly coupled to the associated panel along both the common lower edges 32, 34 and outer side edges 36, 38 of the associated panel 18, 20. Of course, various other arrangements and materials for forming the pockets 28, 30 may also be used.

Figure 1:
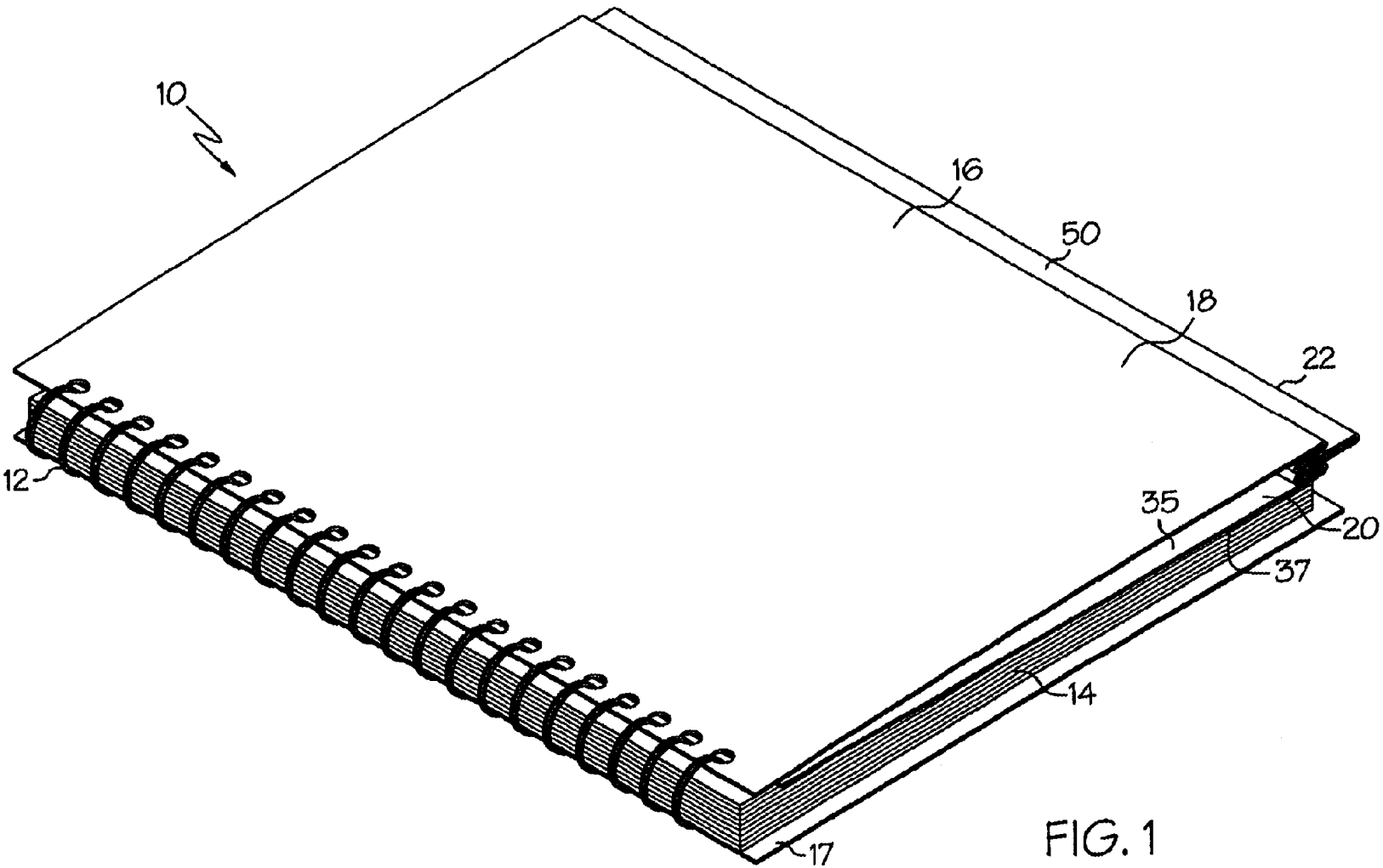
FIG. 1 is a front perspective view of one embodiment of the notebook of the present invention.
Figure 2:
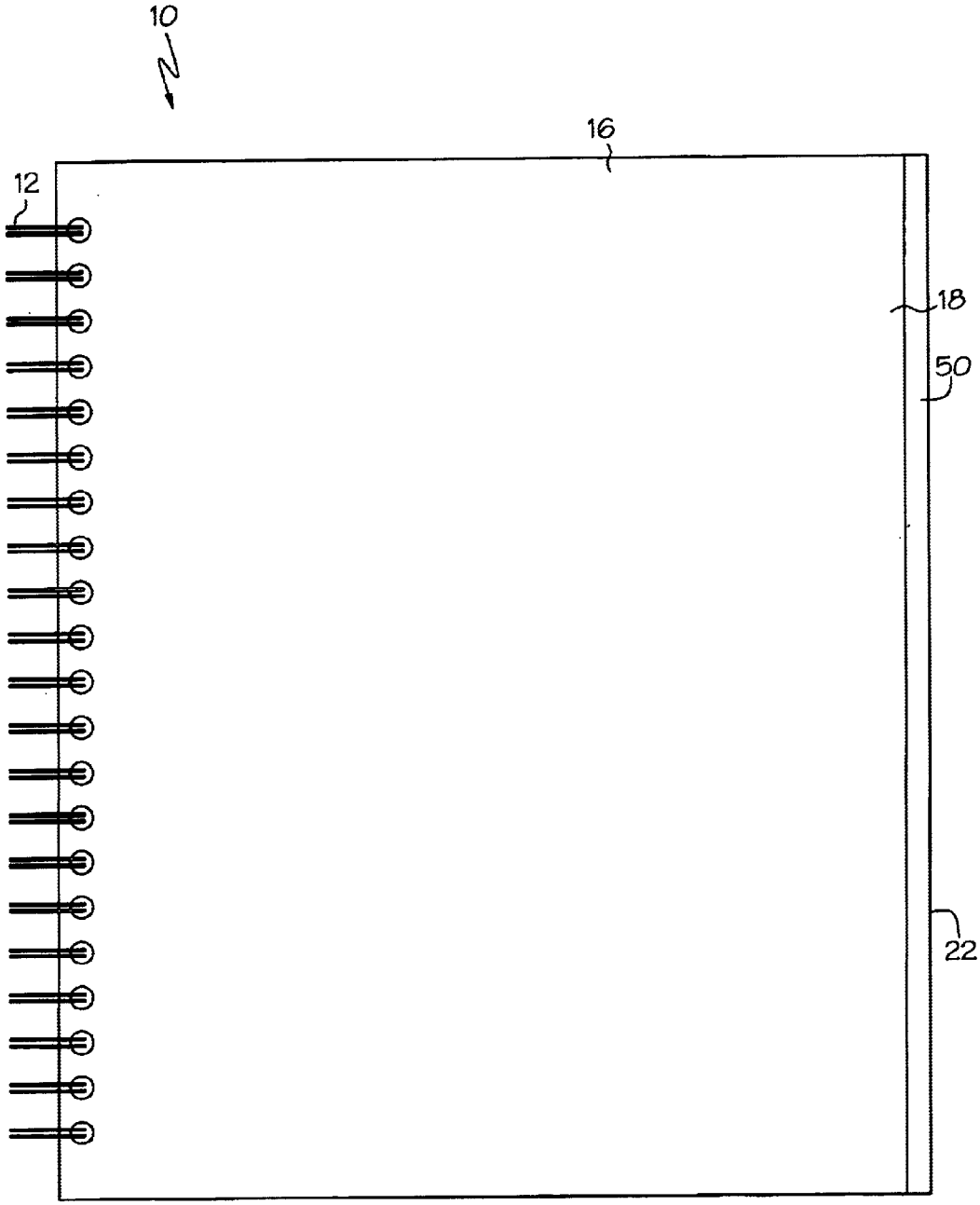
FIG. 2 is a top view of the notebook of FIG. 1.
Figure 3:
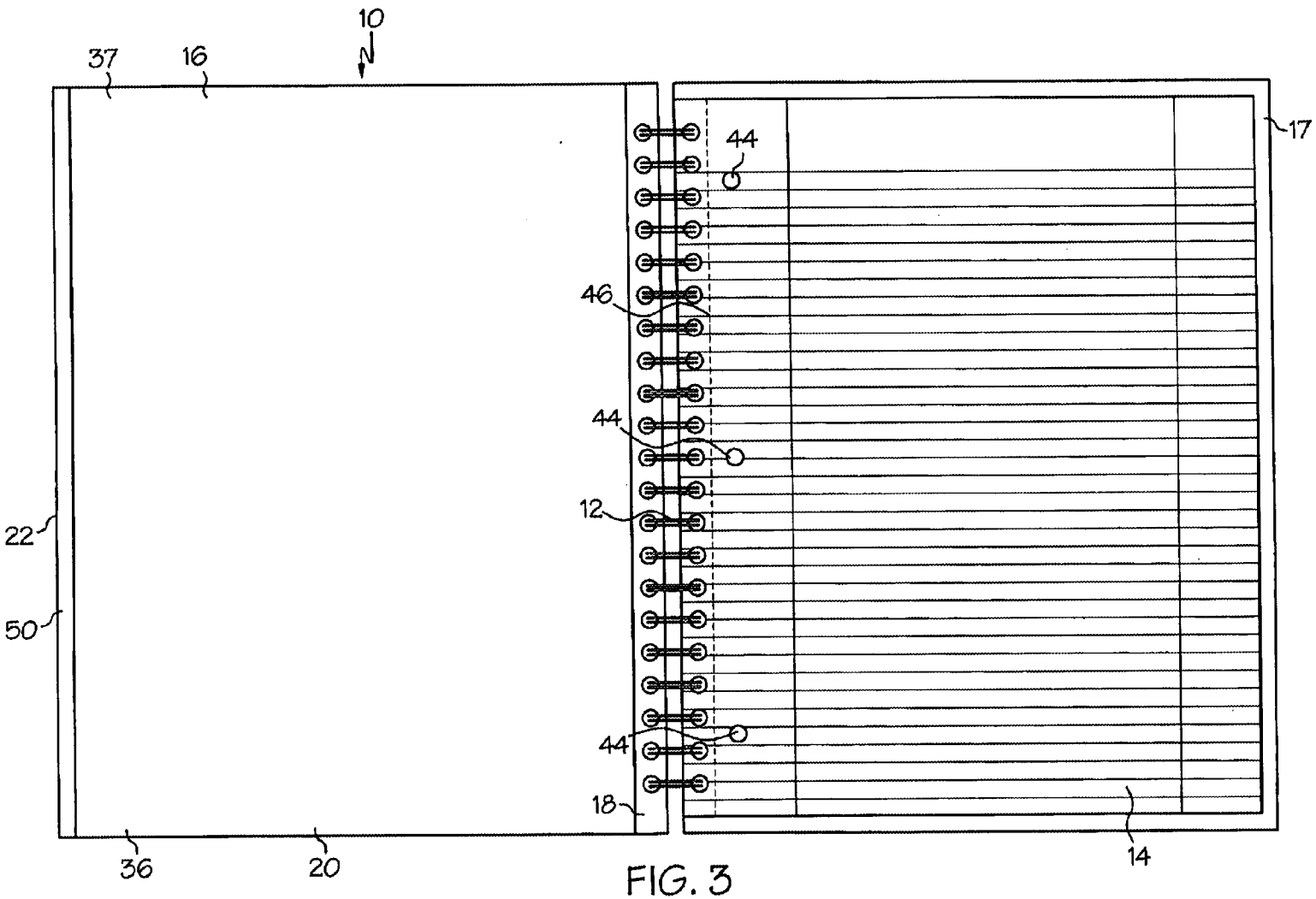
FIG. 3 is a top view of the notebook of FIG. 2, with the cover in a partially open position.

As shown in FIGS. 3 and 4, the inner panel 18 of the cover 16 is bound to the binding mechanism 12, and the inner panel 18 is preferably bound to the binding mechanism 12 along an outer longitudinal edge of the cover 16 (the inner panel 18 being termed the inner panel because it is located adjacent to the binding mechanism 12 as shown in FIG. 4). In this manner, the outer panel 20 of the cover 16 can pivot about the hinge line 22 from a closed position wherein the outer panel 20 facially abuts against inner panel 18 (FIG. 3), and an open position wherein outer panel 20 does not facially abut against inner panel 18 (FIG. 4).

When the notebook 10 is in its fully closed position and the cover 16 is in its folded position (FIGS. 1 and 2), the inner surface 35 of the outer panel 20 abuts against, faces, or is located adjacent to, the inner panel 18, and the outer surface 37 of the outer panel 20 abuts against, faces or is located adjacent to the top sheet of the sheets 14. Thus, in this manner, the portfolio can act as a front cover 16 for the notebook 10 to protect the papers 14. Furthermore, the outer panel 20 of the cover 16 can be interleaved with the pages 14 of the notebook 10 in a desired location and can thereby serve as a place holder or bookmark at a specific desired location inside the notebook 10.

As shown in FIG. 3, each sheet of paper 14 may include a plurality of writing guidelines located thereon, and may also include a set of three spaced holes 44 such that each of the sheets 14 can be attached to a standard three-ring binder, prong mechanism, or the like. Each of the sheets 14 may also include a perforation or tear line 46 extending along the inner longitudinal edge of the sheets 14 adjacent to the binding mechanisms 12 such that each sheet 14 can be torn along the tear line 46 and thereby be separated from the notebook 10.

The cover 16 preferably includes a central spine 50 formed from a plurality of folds of material coupled to (or forming) the hinge line 22. The panels 18, 20 can pivot about the spine 50 and/or hinge line 22 so that the cover 16 can be moved to its unfolded position wherein the panels 18, 20 do not facially abut, but are located adjacent to each other in a common plane, as shown in FIG. 4. The spine portion 50 may include a plurality of spaced pliable prong components 52 coupled thereto to form a supplemental binding mechanism 54 (FIG. 4). In this manner, sheets 14 torn from the notebook 10, or other loose leaf sheets, can be coupled to the spine 50 of the cover 16 by passing the prongs 52 through the associated holes 44 and deflecting the prongs 52 to retain the sheet 14 therein (see FIG. 4). Furthermore, a sheet of paper 14 or other loose items can be located in either of the pockets 28, 30 of the cover 16. In this manner, the cover 16 provides additional pockets, binding mechanism and/or storage space for storing loose leaf papers and other loose items.

The cover 16 may include more or less pockets than the illustrated pockets, as desired, and need not necessarily include the prong binding mechanism 54. Furthermore, various other binding mechanisms, such as three-ring binding mechanisms, other prong binding mechanisms, and the like may be used in place of the prong binding mechanism 54 without departing from the scope of the invention. The cover 16 may be made from a single blank or piece of material that is folded and/or glued to form the cover 16. Of course, the cover 16 can be made from a wide variety of materials, including but not limited to cardboard, thick papers and polypropylene.

Figure 5:
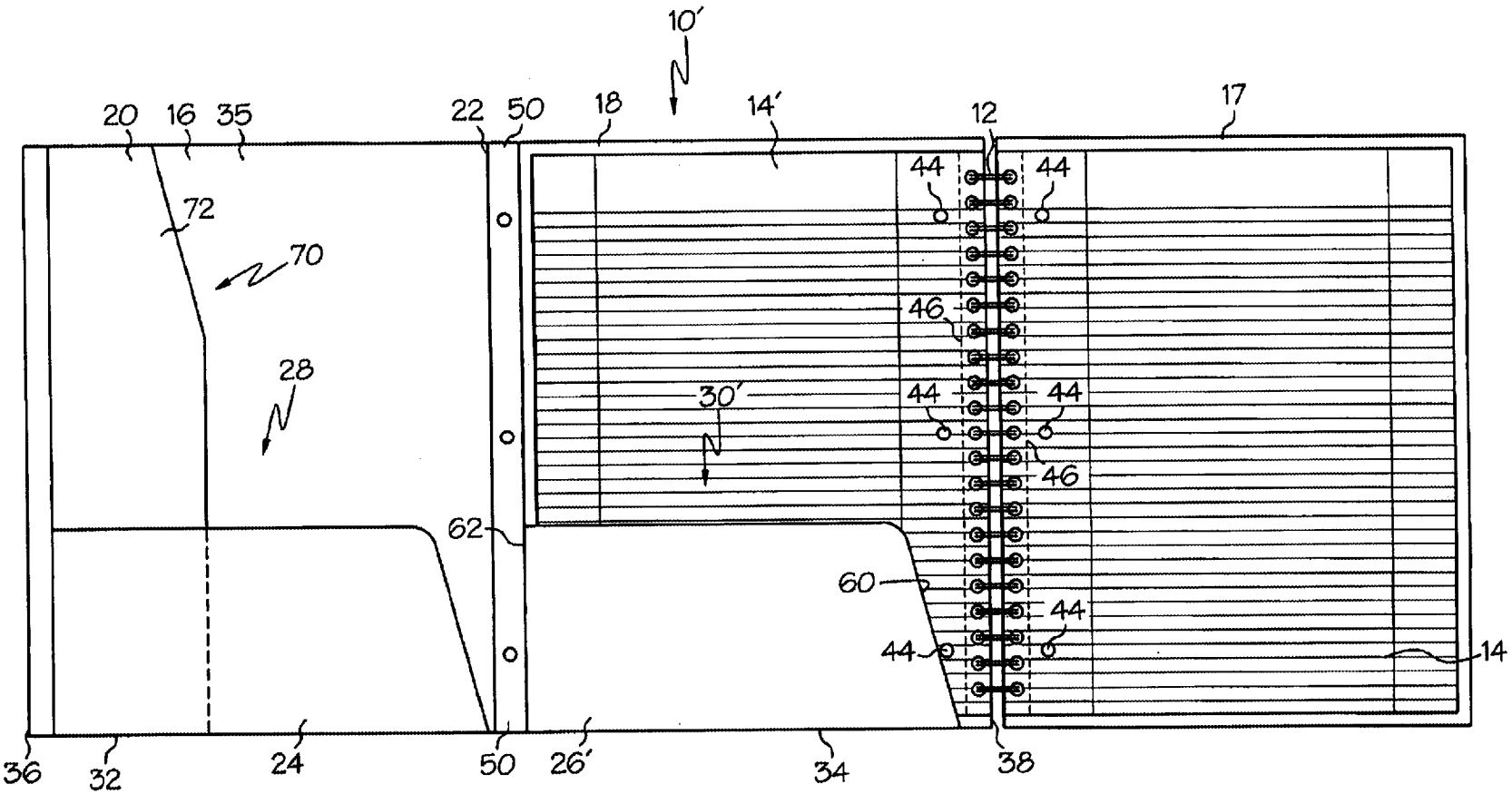
FIG. 5 is a top view of another embodiment of the notebook of the present invention, illustrating the cover in its fully open position and receiving a sheet from the bound notebook therein.

FIG. 5 illustrates an alternate embodiment 10' of the folder. In this embodiment, the outer edge 60 of the pocket 30' located on the inner panel 18 is free (i.e., not coupled to the outer edge 38 of the inner panel 18). This configuration enables a sheet 14 that is still coupled to the binding mechanism 12 to be slid into the pocket 30'. In this case, the lower panel 26' may be coupled to the inner panel 20 or spine 50 along its inner edge 62. Furthermore, the folder 10' of FIG. 5 includes a generally vertically-opening pocket 70 located between a pocket flap 72 and the associated outer panel 20. In the illustrated embodiment, the pocket flap 72 is coupled to the panel 20 along the outer side edge 36 and the lower edge 32 of the panel 20, and the pocket flap 72 is located below the lower panel 24. However, it should be understood that the stacking arrangement of the pocket flap 72 and lower panel 24 may be reversed; or that the panels 18, 20 may include only the vertically-opening pocket 70, only the pockets 28, 30, 30', or any combination of these or other types of pockets.

Figure 6:
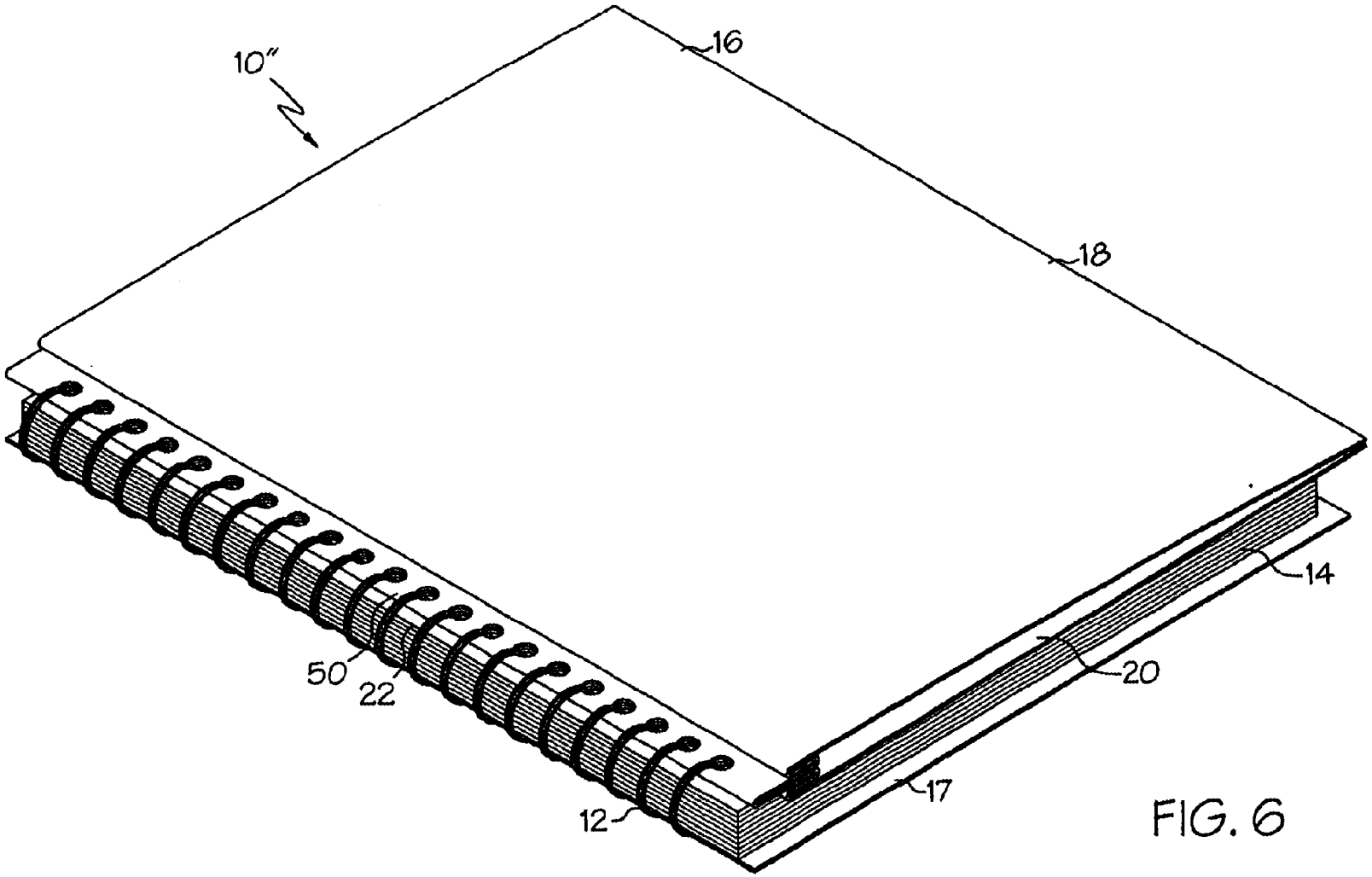
FIG. 6 is a front perspective view of an alternate embodiment of the invention.

Although the cover 16 is illustrated as being coupled to the binding mechanism 12 along an outer edge of one of the panels 18, 20, the cover can be coupled to the binding mechanism 12 at various other locations. For example, as shown in FIG. 6, in one embodiment of the folder 10" the cover 16 is coupled to the binding mechanism 12 at the spine 50 (that is, the cover 16 is coupled to the binding mechanism 12 at or adjacent to the hinge line 22). This configuration enables a user to access both pockets 28, 30 of the cover 16 while maintaining a smaller footprint of the notebook 10".

Having described the invention in detail and by reference to the preferred embodiments, it will be apparent that modification and variations thereof are possible without departing from the scope of the invention.

What is claimed is:

1. A notebook comprising:

a plurality of sheets of paper;

a binding mechanism binding said plurality of sheets together; and a cover bound to said plurality of sheets of paper by said binding mechanism, said cover including first and second opposed panels directly coupled together and having a hinge line extending between said opposed panels, said cover including a lower panel fixedly coupled to and facially abutting at least one of said panels to form a pocket therebetween wherein said first panel is pivotable about said hinge line to move said cover to a folded position such that said first panel faces and is generally parallel to said second panel, and wherein said pocket is located between said first and second panels when said cover is in said folded position and wherein said plurality of sheets of paper are not located between said first and second panels when said cover is in said folded position.

2. The notebook of claim 1 wherein said cover is bound to said binding mechanism along an outer edge of said cover, said outer edge being generally spaced away from said hinge line and located on a generally opposite side of said cover relative to said hinge line.

3. The notebook of claim 2 wherein said outer edge and said hinge line are generally parallel.

4. The notebook of claim 2 wherein said hinge line and said binding mechanism are generally parallel.

5. The notebook of claim 1 wherein said first panel is pivotable away from said second panel.

6. The notebook of claim 1 wherein said cover is pivotable about said binding mechanism such that said second panel can facially abut against a top sheet of said plurality of sheets of paper.

7. The notebook claim 1 wherein said lower panel is fixedly and not pivotally coupled to said at least one panel.

8. The notebook of claim 1 wherein said lower panel is fixedly coupled to said at least one panel generally along the entire length of at least two edges of said lower panel.

9. The notebook of claim 1 further including a supplemental binding mechanism coupled to said cover at or adjacent to said hinge line.

10. The notebook of claim 9 wherein said supplemental binding mechanism is a different type of binding mechanism that said binding mechanism.

11. The notebook of claim 9 wherein said supplemental binding mechanism includes a plurality of bendable prong components.

12. The notebook of claim 11 wherein said supplemental binding mechanism extends generally parallel to said hinge line.

13. The notebook of claim 1 wherein each panel includes a pocket located thereon.

14. The notebook of claim 1 wherein said cover is bound to said binding mechanism along or adjacent to said hinge line.

15. The notebook of claim 1 wherein said opposed panels are made from a single, unitary sheet of material.

16. The notebook of claim 1 wherein at least part of said binding mechanism extends through said plurality of sheets to bind said sheets together and at least part of said binding mechanism extends through said cover to bind said cover to said plurality of sheets.

17. The notebook of claim 1 wherein said binding mechanism is a coil or spiral binding mechanism.

18. The notebook of claim 1 wherein each panel is a generally flat, planar component free of any hinge lines.

19. The notebook of claim 1 wherein each of said first and second panels are generally flat and include a pair of opposed generally parallel major faces which together comprise the majority of the surface area of the associated panel, and wherein a major face of said first panel is generally parallel to and faces a major face of said second panel when said cover is in said folded position.

20. A notebook comprising:

a plurality of sheets of paper;

a binding mechanism binding said plurality of sheets together; and a cover bound to said plurality of sheets of paper by said binding mechanism, said cover including first and second panels coupled together and having a hinge line extending between said first and second panels, said cover including a supplemental binding mechanism coupled to said cover at or adjacent to said hinge line wherein one of said panels is pivotable about said hinge line to move said cover to a folded position such that said panels are generally parallel and facing each other, wherein said binding mechanism is located between said panels when said cover is in said folded position and wherein said cover is bound to said binding mechanism along an outer edge of said cover, said outer edge being generally spaced away from said hinge line and located on a generally opposite side of said cover relative to said hinge line.

21. The notebook of claim 20 wherein said first panel is pivotable about said hinge line between said folded position and an unfolded position wherein said first panel is located adjacent to and generally co-planar with said second panel and generally does not face said second panel, said cover including a lower panel fixedly coupled to and facially abutting at least one of said panels to form a pocket therebetween and wherein said pocket is located between said first and second panels when said first panel is in said folded position.

22. The notebook of claim 20 wherein said cover is pivotable about said binding mechanism such that said second panel can facially abut against a top sheet of said plurality of sheets of paper.

23. The notebook of claim 20 wherein said supplemental binding mechanism includes a plurality of manually bendable prong components.

24. The notebook of claim 20 wherein said cover includes a lower panel fixedly coupled to and facially abutting at least one of said panels to form a pocket therebetween.

25. The notebook of claim 20 wherein said cover is bound to said binding mechanism along or adjacent to said hinge line.

26. The notebook of claim 20 wherein said opposed panels are directly coupled together.

27. The notebook of claim 26 wherein each panel is a generally flat, planar component free of any hinge lines.

28. The notebook of claim 20 wherein at least part of said binding mechanism extends through said plurality of sheets to bind said sheets together and at least part of said binding mechanism extends through said cover to bind said cover to said plurality of sheets.

29. The notebook of claim 20 wherein said binding mechanism is a coil or spiral binding mechanism.

30. The notebook of claim 20 wherein said supplemental binding mechanism is a different type of binding mechanism that said binding mechanism.

31. The notebook of claim 23 wherein said supplemental binding mechanism extends generally parallel to said hinge line.

32. The notebook of claim 20 wherein said plurality of sheets of sheets of paper are not located between said panels when said cover in is said folded position.

33. The notebook of claim 20 wherein said hinge line and said binding mechanism are generally parallel.

34. The notebook of claim 20 wherein said outer edge and said hinge line are generally parallel.

35. The notebook of claim 20 wherein each of said first and second panels are generally flat and include a pair of opposed generally parallel major faces which together comprise the majority of the surface area of the associated panel, and wherein a major face of said first panel is generally parallel to and faces a major face of said second panel when said cover is in said folded position.

36. A notebook comprising:

a plurality of sheets of paper;

a binding mechanism, at least part of said binding mechanism extending through each of said sheets to bind said plurality of sheets together; and a cover, wherein at least part of said binding mechanism extends through said cover to bind said cover to said plurality of sheets of paper, said cover including first and second opposed panels directly coupled together and having a hinge line extending between said opposed panels such that each panel is pivotable relative to the other panel about said hinge line, wherein said binding mechanism generally extends along an outer edge of said folder that is located on a generally opposite side of said folder relative to said hinge line.

37. The notebook of claim 36 wherein said binding mechanism is a coil or spiral binding mechanism.

38. The notebook of claim 36 wherein said binding mechanism contacts or engages said cover at or adjacent to said outer edge to bind said cover to said plurality of sheets of paper.

39. The notebook of claim 36 wherein said outer edge is generally parallel to said hinge line.

40. The notebook of claim 36 wherein said outer edge is generally spaced apart from said hinge line.

41. The notebook of claim 36 wherein said hinge line and said binding mechanism are generally parallel.

* * * * *